US010612209B2

(12) United States Patent
Williams

(10) Patent No.: US 10,612,209 B2
(45) Date of Patent: Apr. 7, 2020

(54) VARIABLE CONNECTION SIZE EXCAVATOR MAST DEVICE

(71) Applicant: Diamond Mowers LLC, Sioux Falls, SD (US)

(72) Inventor: Nathan E. Williams, Sioux Falls, SD (US)

(73) Assignee: Diamond Mowers LLC, Sioux Falls, SD (US)

( * ) Notice: Subject to any disclaimer, the term of this patent is extended or adjusted under 35 U.S.C. 154(b) by 0 days.

(21) Appl. No.: 16/109,171

(22) Filed: Aug. 22, 2018

(65) Prior Publication Data

US 2019/0063033 A1 Feb. 28, 2019

Related U.S. Application Data

(60) Provisional application No. 62/551,049, filed on Aug. 28, 2017.

(51) Int. Cl.
*E02F 3/38* (2006.01)
*E02F 3/30* (2006.01)

(52) U.S. Cl.
CPC ..... *E02F 3/382* (2013.01); *E02F 3/30* (2013.01)

(58) Field of Classification Search
CPC ..... E02F 3/30; E02F 3/3604; E02F 3/3636; E02F 3/382; E02F 3/96
USPC ..... 37/397; 172/272; 403/116, 151, 321, 403/322.3, 324, 379.5; 414/686, 722, 723
See application file for complete search history.

(56) References Cited

FOREIGN PATENT DOCUMENTS

CA 2234893 A1 * 10/1999 ..... E02F 3/3613

* cited by examiner

*Primary Examiner* — Ronald P Jarrett
(74) *Attorney, Agent, or Firm* — Ballard Spahr LLP

(57) ABSTRACT

A variable connection size excavator mast device provides attachment for varied mast sizes and geometries eliminating need for a unique design for each excavator and deck type. The device includes a base plate and a pair of mast plates. The pair of mast plates is coupled to and extends upwardly from the mast plate. The mast plates are perpendicular to the base plate and parallel to each other. A fixed pin is coupled to and extends between the mast plates. A sliding pin is adjustably coupled to and extends between the mast plates. The sliding pin is parallel to the fixed pin.

16 Claims, 7 Drawing Sheets

VARIABLE CONNECTION SIZE EXCAVATOR MAST DEVICE

CROSS-REFERENCE TO RELATED APPLICATIONS

I hereby claim the benefit under 35 U.S.C. Section 119(e) of U.S. Provisional application 62/551,049 filed Aug. 28, 2017.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mast devices and more particularly pertains to a new mast device for providing attachment for varied mast sizes and geometries eliminating need for a unique design for each excavator and deck type.

BRIEF SUMMARY OF THE INVENTION

An embodiment of the disclosure meets the needs presented above by generally comprising a base plate and a pair of mast plates. The pair of mast plates is coupled to and extends upwardly from the mast plate. The mast plates are perpendicular to the base plate and parallel to each other. A fixed pin is coupled to and extends between the mast plates. A sliding pin is adjustably coupled to and extends between the mast plates. The sliding pin is parallel to the fixed pin.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
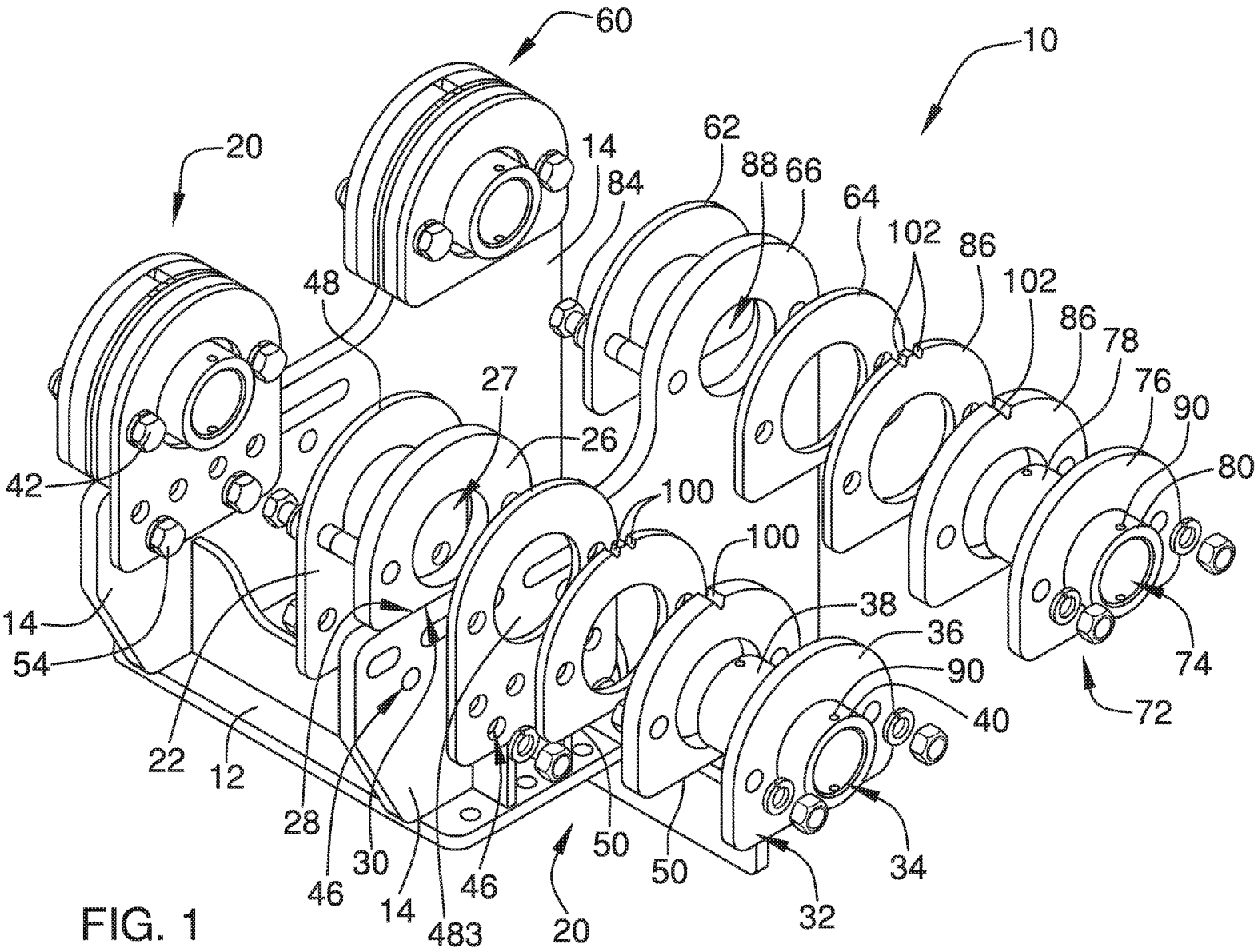
FIG. 1 is a top front side partially exploded view of a variable connection size excavator mast device according to an embodiment of the disclosure.
Figure 2:
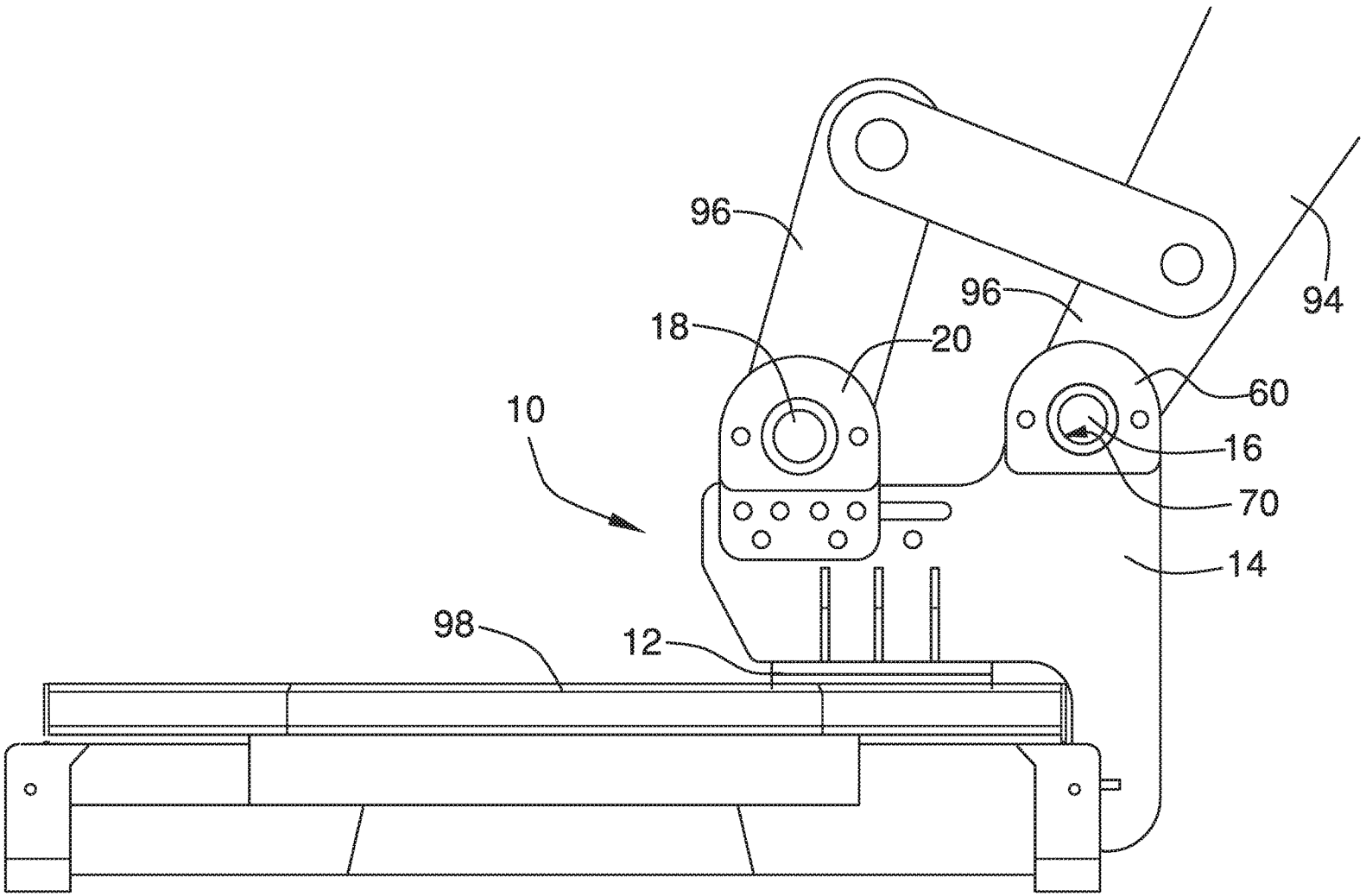
FIG. 2 is a sideview of an embodiment of the disclosure in use.
Figure 3:
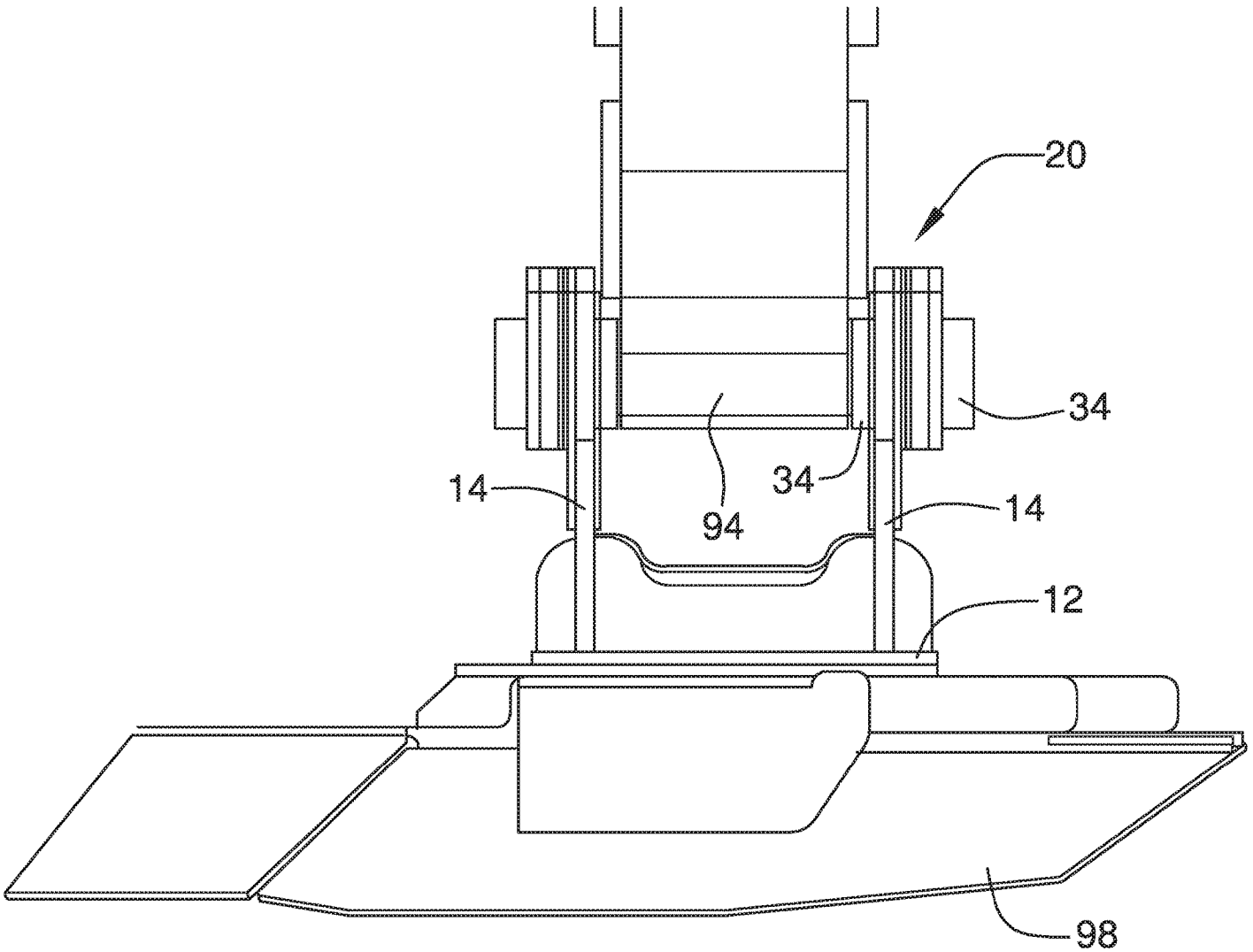
FIG. 3 is a front view of an embodiment of the disclosure in use.
Figure 4:
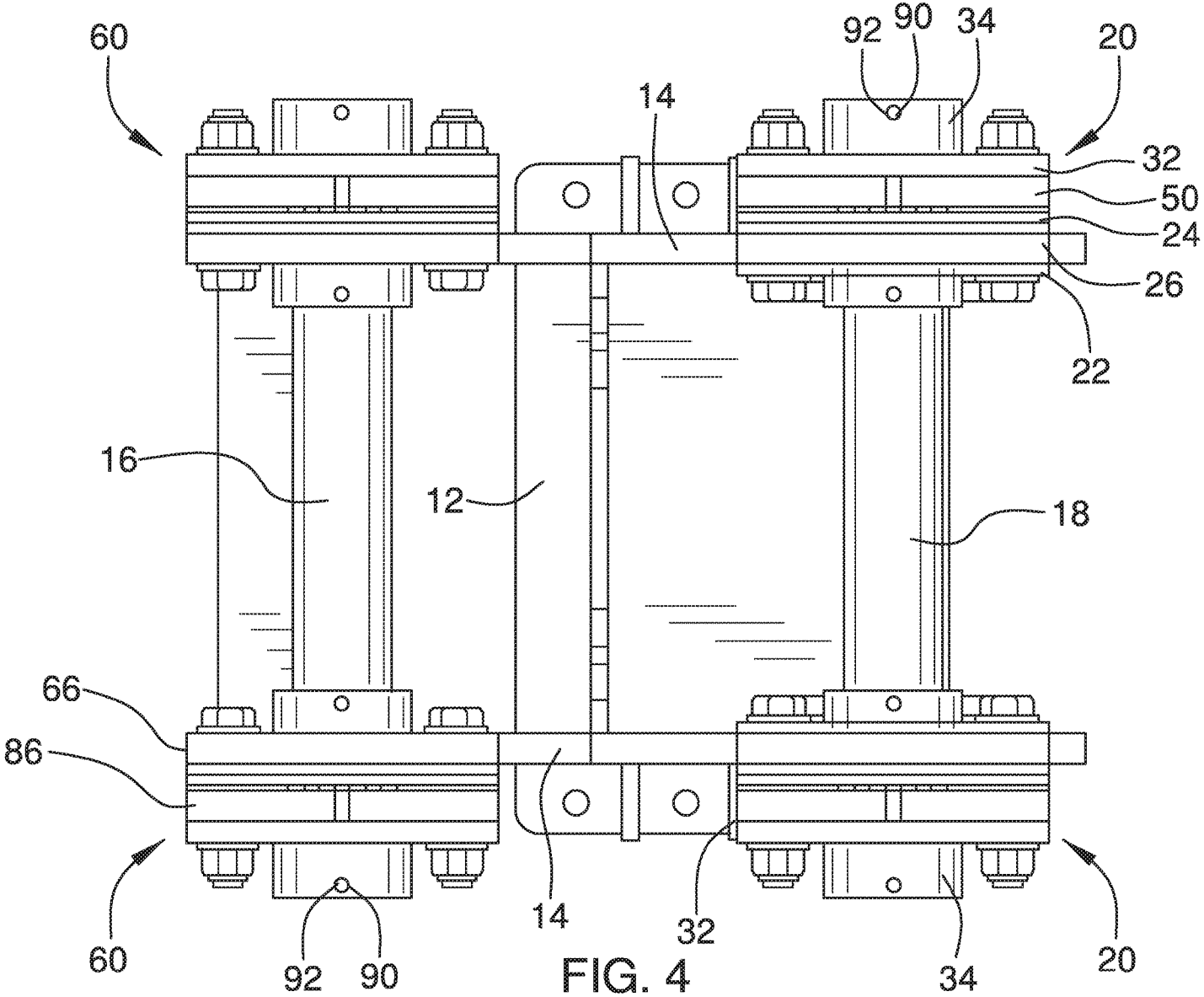
FIG. 4 is a top view of an embodiment of the disclosure.
Figure 5:
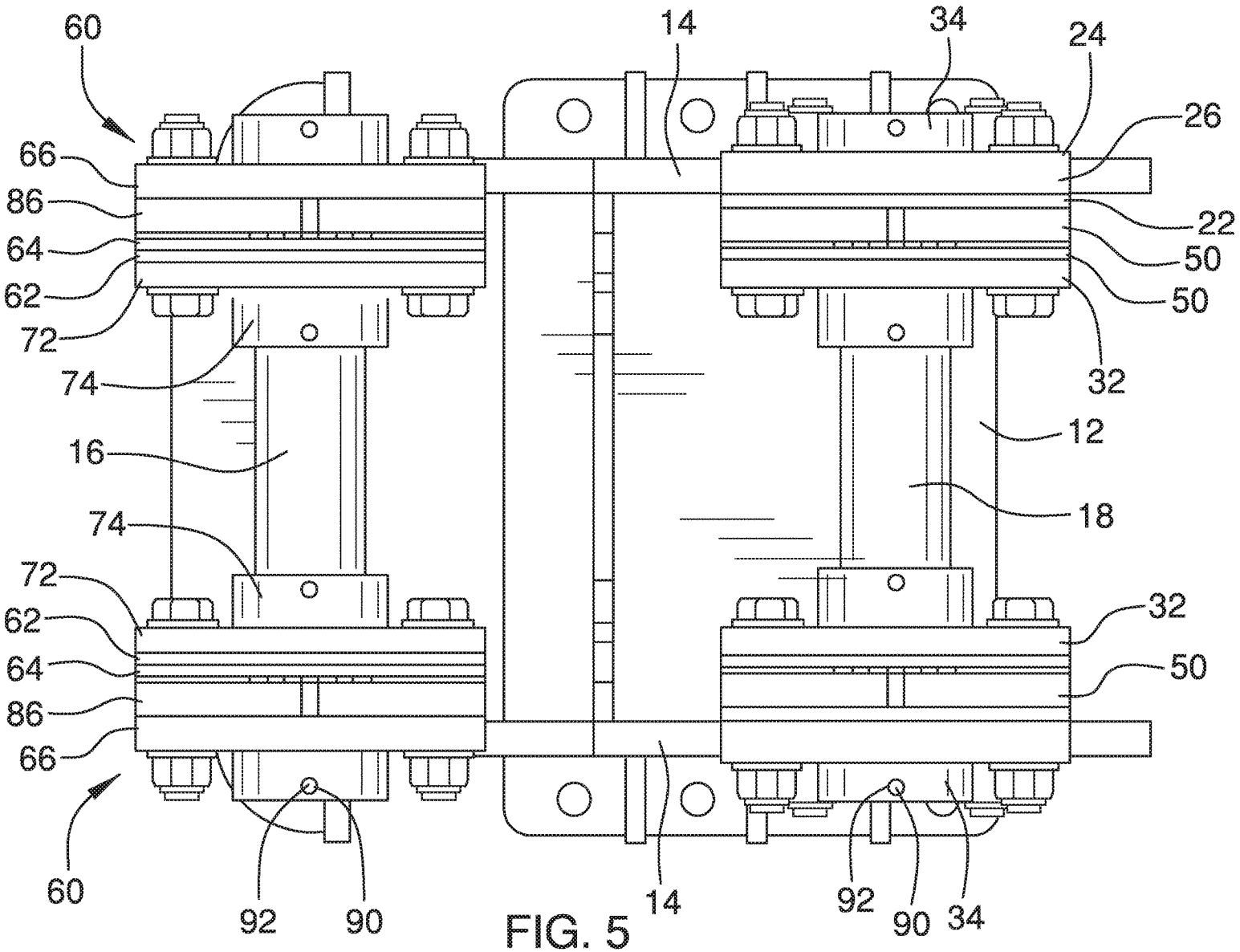
FIG. 5 is a top view of an embodiment of the disclosure in an alternate configuration.
Figure 6:
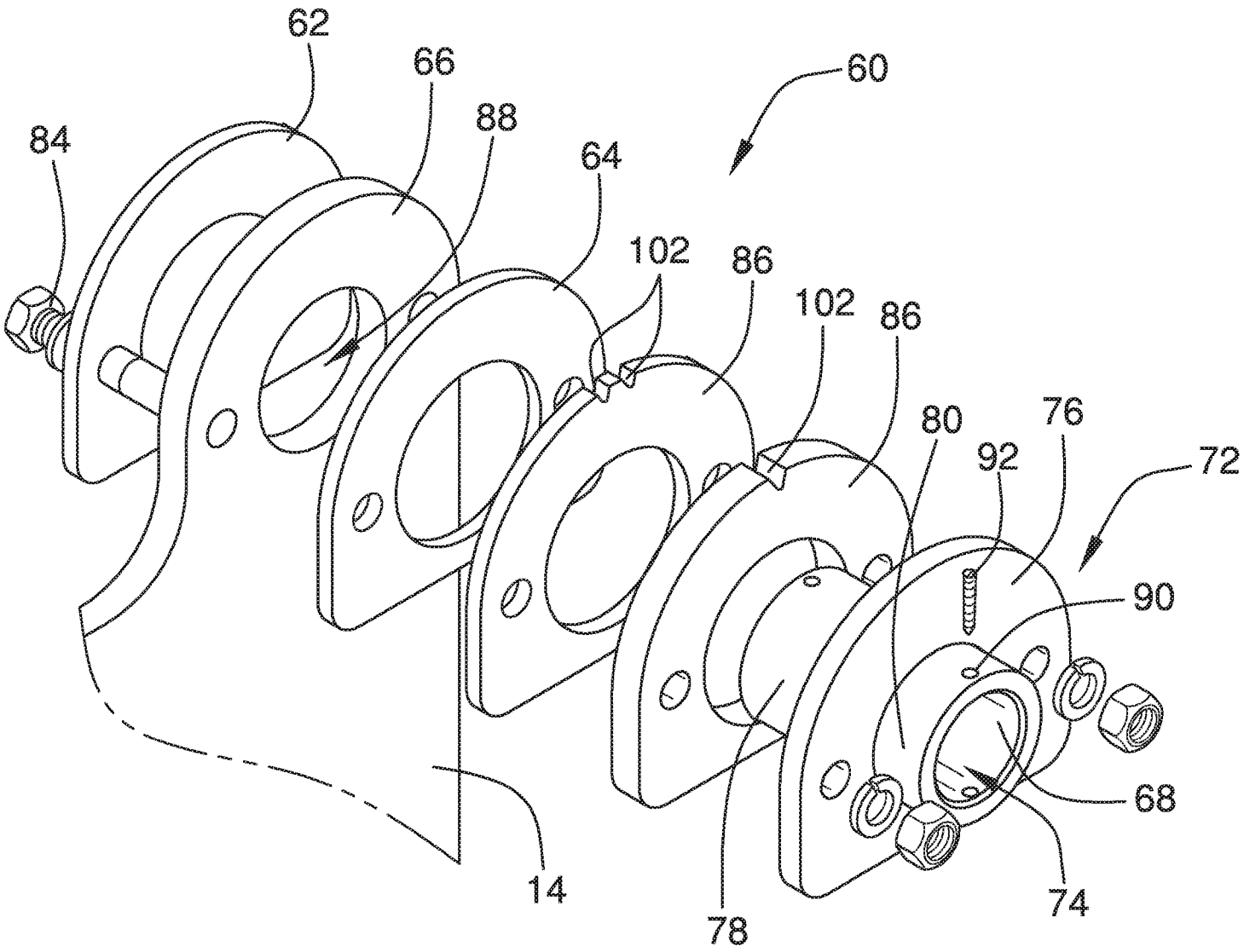
FIG. 6 is a detailed exploded view of a fixed pin coupling assembly.
Figure 7:
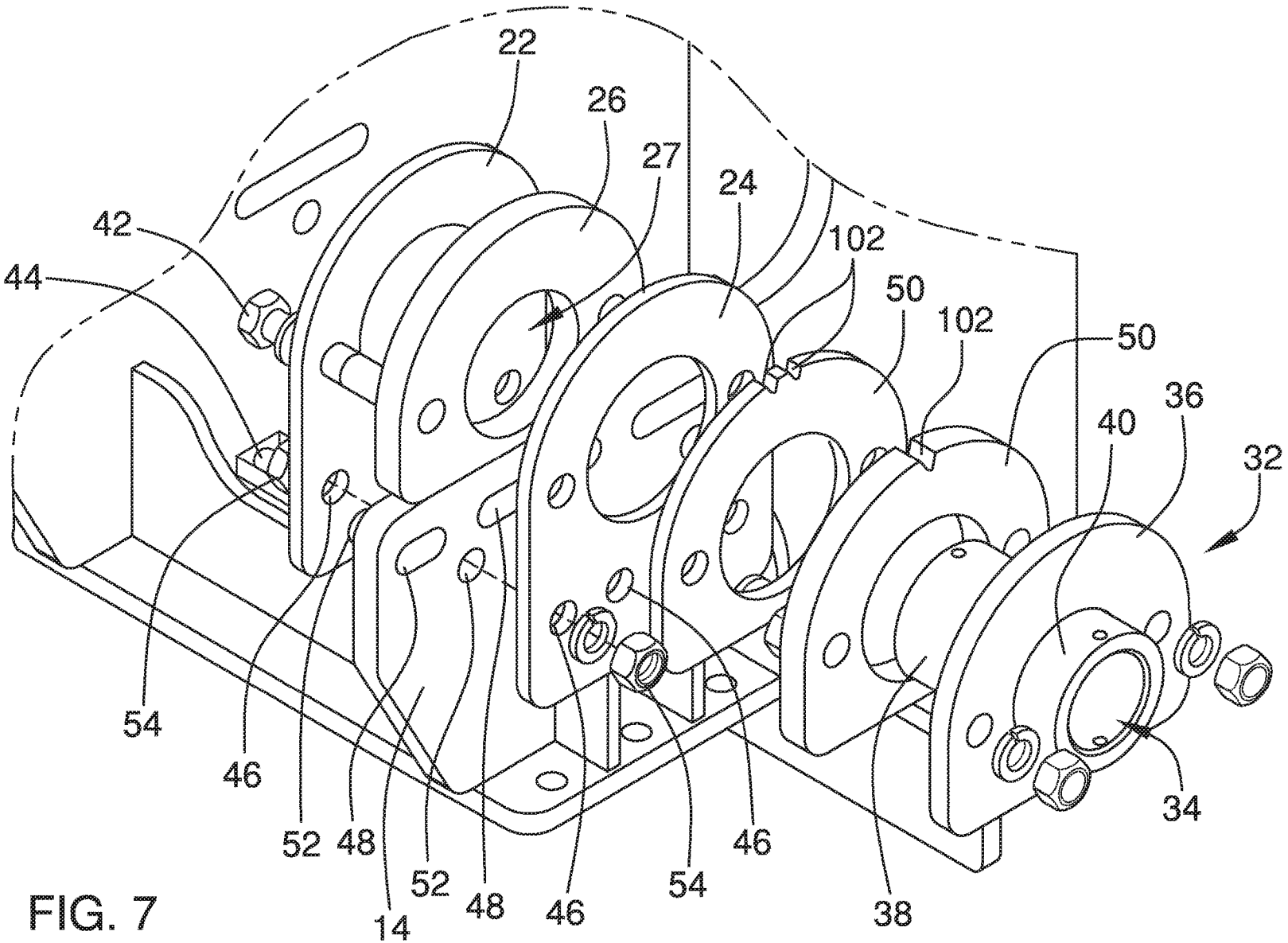
FIG. 7 is a detailed exploded view of a sliding pin coupling assembly.

With reference now to the drawings, and in particular to FIGS. 1 through 7 thereof, a new mast device embodying the principles and concepts of an embodiment of the disclosure and generally designated by the reference numeral 10 will be described.

As best illustrated in FIGS. 1 through 7, the variable connection size excavator mast device 10 generally comprises a base plate 12 and a pair of mast plates 14. The pair of mast plates 14 is coupled to and extends upwardly from the base plate 12. The mast plates 14 are perpendicular to the base plate 12 and parallel to each other. A fixed pin 16 is coupled to and extends between the mast plates 14. A sliding pin 18 is adjustably coupled to and extends between the mast plates 14. The sliding pin 18 is parallel to the fixed pin 16. The base plate 12 is typically coupled to a mower deck 98 positioning the fixed pin 16 and sliding pin 18 for engagement by mast jaws 96 of a mast 94 to coupled the mower deck 98 to the mast 94.

The device 10 includes a pair of sliding pin coupling assemblies 20 and a pair of fixed pin coupling assemblies 60 to allow for interchangeable connection of the fixed pin 16 and sliding pin 18 with another fixed pin 16 or sliding pin 18 having a desired diameter for the specific type of mast 94 being coupled to the device 10 so that the mast jaws 96 of the mast 94 fit correctly.

Each of the sliding pin coupling assemblies 20 is couplable to a respective one of the mast plates 14 at an adjustable position relative to the associated mast plate 14 wherein the sliding pin 18 is positionable a desired distance from the fixed pin 16. Each sliding pin coupling assembly 20 includes an interior sliding pin coupling plate 22 and an exterior sliding pin coupling plate 24. A load plate 26 is positioned between the interior sliding pin coupling plate 22 and the exterior sliding pin coupling plate 24. The load plate 26 has a bottom edge 28 positionable to abut a top edge 30 of the associated one of the mast plates 14 wherein the load plate 26 is slidable along the top edge 30 of the associated one of the mast plates 14 until secured as described below.

Each sliding pin coupling assembly 20 further includes a sliding pin boss sub-assembly 32. The sliding pin boss sub-assembly 32 has a sliding pin cylinder 34 extending perpendicularly through a medial plate 36. The sliding pin cylinder 34 extends through each of the interior sliding pin coupling plate 22, the exterior sliding pin coupling plate 24, and the load plate 26. Each of the sliding pin boss sub-assemblies 32 has the medial plate 36 being offset from a middle of the sliding pin cylinder 34 wherein the sliding pin cylinder 34 defines a longer sliding pin cylinder section 38 and a shorter sliding pin cylinder section 40 extending from opposite sides of the medial plate 36. The sliding pin boss sub-assembly 32 is selectively positionable adjacent to one of the interior sliding pin coupling plate 22 and the exterior sliding pin coupling plate 24 wherein a distance the sliding pin cylinder 34 extends between the mast plates 14 is adjustable. Each sliding pin boss sub-assembly 32 is also reversibly positionable relative to the associated one of the mast plates 14 wherein a distance the sliding pin cylinder 34 of each sliding pin coupling assembly 20 extends between the mast plates 14 is adjustable.

Each sliding pin coupling assembly 20 includes a plurality of upper sliding pin fasteners 42. Each of the upper sliding pin fasteners 42 extends through and fastens together the interior sliding pin coupling plate 22, the load plate 26, the exterior sliding pin coupling plate 24, and the sliding pin boss sub-assembly 32. Each sliding pin coupling assembly further includes a plurality of lower sliding pin fasteners 44. Each of the lower sliding pin fasteners 44 extends through aligned holes 46 in the interior sliding pin coupling plate 22, the exterior sliding pin coupling plate 24, and a slot 48 through the associated one of the mast plates 14. The lower sliding pin fasteners 44 compress the associated one of the mast plates 14 between the interior sliding pin coupling plate 22 and the exterior sliding pin coupling plate 24 such that the boss plate 32 is secured in a selectable fixed position a desired spacing from the fixed pin 16. The sliding pin cylinders 34 are positionable in linear alignment across the base plate 12 wherein the sliding pin 18 is insertable through and extends between the sliding pin cylinders 34.

An optional sliding pin spacer 50 is couplable between the sliding pin boss sub-assembly 32 and the load plate 26 wherein a distance the sliding pin cylinder 34 extends between the mast plates 14 is further adjustable. One or more sliding pin spacers 50 may be used as desired. Further, the sliding pin spacers 50 may be provided having varied thicknesses to provide the desired spacing using a single sliding pin spacer 50 or a combination of sliding pin spacers 50. Sliding pin spacers 50 having different thicknesses can be identified using indicia or a number of slots 100 such that equivalent thickness all have the same number of slots 100.

Each sliding pin coupling assembly may further include a plurality of sliding pin position apertures 52 extending through each of the interior sliding pin coupling plates 22, the exterior sliding pin coupling plate 24, and the associated one of the mast plates 14. At least one sliding pin position apertures 52 of each of the interior sliding pin coupling plate 22, the exterior sliding pin coupling plate 24, and the associated mast plate 14 is alignable wherein insertion of a positioning fastener 54 through the aligned sliding pin positioning apertures 52 fixes a position of the boss plate 32 relative to the associated one of the mast plates 14.

The load plate 26 has a load plate aperture 27 complementary in size to an outer diameter of the sliding pin cylinder 34. This transfers the load from the sliding pin 18 through the load plate cylinder 34 to the load plate 26 and on to the associated mast plate 14 such that no shearing force is delivered from the sliding pin 18 to the upper sliding pin fasteners 42, the lower sliding pin fasteners 44, or the positioning fasteners 54.

Each fixed pin coupling assembly 60 includes structures generally analogous to the structures of the sliding pin coupling assemblies 20. Each fixed pin coupling assembly 60 includes an interior fixed pin coupling plate 62 and an exterior fixed pin coupling plate 64. An upward extension 66 of a respective one of the mast plates 14 is positioned between the interior fixed pin coupling plate 62 and the exterior fixed pin coupling plate 64. This is similar to the use of the load plate 26 but provides a fixed position as opposed to slidable adjustment prior to being secured. Each fixed pin coupling assembly 60 includes a fixed pin boss sub-assembly 72. The fixed pin boss sub-assembly 72 has a fixed pin cylinder 74 extending perpendicularly through a middle plate 76. The fixed pin cylinder 74 extends through each of the interior fixed pin coupling plate 62, the exterior fixed pin coupling plate 64, and the upward extension 66 of the respective one of the mast plates 14. Each of the fixed pin cylinders 74 is positioned in linear alignment across the base plate 12. Each of the fixed pin cylinders 74 has an interior diameter 68 complementary to an outer diameter 70 of the fixed pin 16 wherein the fixed pin 16 is positionable within and extends between the fixed pin cylinders 74. Each of the fixed pin boss sub-assemblies 72 has the middle plate 76 being offset from a middle of the fixed pin cylinder 74 wherein the fixed pin cylinder 74 defines a longer fixed pin cylinder section 78 and a shorter fixed pin cylinder section 80 extending from opposite sides of the middle plate 76. The fixed pin boss sub-assembly 72 is selectively positionable adjacent to one of the interior fixed pin coupling plate 62 and the exterior fixed pin coupling plate 64 wherein a distance the fixed pin cylinder 74 extends between the mast plates 14 is adjustable. Each fixed pin boss sub-assembly 72 is also reversibly positionable relative to the upward extension 66 of the respective one of the mast plates 14 wherein the distance the fixed pin cylinder 74 of each fixed pin coupling assembly 60 extends between the mast plates 14 is additionally adjustable.

Each fixed pin coupling assembly 60 includes a plurality of fixed pin assembly fasteners 84. Each fixed pin assembly fastener 84 extends through each of the interior fixed pin coupling plate 62, the upward extension 66 of the respective one of the mast plates 14, the exterior fixed pin coupling plate 64, a fixed pin spacer 86, and the fixed pin boss sub-assembly 72 wherein the fixed pin fasteners 84 couple the interior fixed pin coupling plate 62, the exterior fixed pin coupling plate 64, the fixed pin spacer 86, and the fixed pin boss sub-assembly 72 in fixed positions relative to the respective one of the mast plates 14. The fixed pin spacer 86, as first mentioned above, is couplable between the fixed pin boss sub-assembly 72 and the upward extension 66 of the respective one of the mast plates 14 wherein a distance the fixed pin cylinder 74 extends between the mast plates 14 is further adjustable. The fixed pin spacer 86 may be similarly provided in multiple variously sized thicknesses and be marked or utilize slots 102 in the same manner as the sliding pin spacers 50 described above.

Each mast plate 14 has a fixed pin aperture 88 having a diameter complementary to an outer diameter of the fixed pin cylinder 74. Similar to the load plate aperture 27, the fixed pin aperture 88 transfers load from the fixed pin cylinder 74 to the mast plate 14 preventing shearing force on the fixed pin fasteners 84.

Each of the sliding pin cylinders 34 and the fixed pin cylinders 74 has a respective threaded opening 90. Threaded engagement by a pin securement fastener 92 allows the pin securement fastener 92 to extend through the associated sliding pin cylinder 34 or fixed pin cylinder 74 to engage and secure the sliding pin 18 or fixed pin 16 into a fixed position relative to the sliding pin cylinder 34 or fixed pin cylinder 74. Thus, each of the sliding pin 18 and the fixed pin 16 are removable and replaceable.

It can be appreciated that the device 10 is highly customizable. This includes specific dimensions of each of the sliding pin 18 and the fixed pin 16, particularly an outer diameter of each, being selected to correspond to particular mast specifications. The sliding pin boss sub-assembly 32 and fixed pin boss sub-assembly 72 may be provided having varied specific dimensions, particularly the interior diameter of the sliding pin cylinder 34 and fixed pin cylinder 74, to correspond to and complement the specific dimensions of the variable sizes of the sliding pin 18 and fixed pin 16.

In use, each sliding pin coupling assembly 20 and fixed pin coupling assembly 60 is assembled to provide a desired spread for the particular mast to be coupled to the device 10. The spread is the length of the sliding pin 18 or fixed pin 16 exposed between the sliding pin cylinders 34 or fixed pin cylinders 74 between the mast plates 14. The relative positioning of the components of each of the sliding pin coupling assembly 20 and fixed pin coupling assembly 60 will vary the spread and the spread may be the same or different for each of the sliding pin 18 and the fixed pin 16 depending on the specifications of the mast to be coupled to the device 10. Additionally, there may be interchangeable sliding pin boss sub-assemblies 32 and fixed pin boss sub-assemblies 72, each having a common outer diameter for the sliding pin cylinder 34 and fixed pin cylinder 74. However, other dimensions may be varied including the overall length and inner diameter of each of the sliding pin cylinder 34 and fixed pin cylinder 74 to provide for variation of the spread or variation in the diameter of the fixed pin 16 and the sliding pin 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A variable excavator mast coupling device comprising:

a base plate;

a pair of mast plates, said pair of mast plates being coupled to and extending upwardly from said base plate, said mast plates being perpendicular to said base plate and parallel to each other;

a fixed pin coupled to and extending between said mast plates;

a sliding pin adjustably coupled to and extending between said mast plates, said sliding pin being parallel to said fixed pin; and a pair of sliding pin coupling assemblies, each of said sliding pin coupling assemblies being couplable to a respective one of said mast plates at an adjustable position, wherein said sliding pin is positionable a desired distance from said fixed pin;

wherein each said sliding pin coupling assembly comprises:

an interior sliding pin coupling plate;

an exterior sliding pin coupling plate;

a load plate, said load plate being positioned between said interior sliding pin coupling plate and said exterior sliding pin coupling plate, said load plate having a bottom edge positionable to abut a top edge of an associated one of said mast plates, wherein said load plate is slidable along said top edge of said associated one of said mast plates; and a sliding pin boss sub-assembly, said sliding pin boss sub-assembly having a sliding pin cylinder extending perpendicularly through a medial plate, said sliding pin cylinder extending through each of said interior sliding pin coupling plate, said exterior sliding pin coupling plate, and said load plate.

2. The device of claim 1, wherein each said sliding pin coupling assembly further comprises a plurality of upper sliding pin fasteners, each of said upper sliding pin fasteners extending through and fastening together said interior sliding pin coupling plate, said load plate, said exterior sliding pin coupling plate, and said sliding pin boss plate sub-assembly.

3. The device of claim 1, wherein each said sliding pin coupling assembly further comprises a plurality of lower sliding pin fasteners, each of said lower sliding pin fasteners extending through aligned holes in said interior sliding pin coupling plate, said exterior sliding pin coupling plate, and a slot through one of said mast plates, said lower sliding pin fasteners compressing said one of said mast plates between said interior sliding pin coupling plate and said exterior sliding pin coupling plate such that said boss plate is secured in a selectable fixed position a desired spacing from said fixed pin, said sliding pin cylinders being positionable in linear alignment across said base plate, wherein said sliding pin is insertable through and extending between said sliding pin cylinders.

4. The device of claim 1, wherein each of said sliding pin boss sub-assemblies has said medial plate being offset from said middle of said sliding pin cylinder, wherein said sliding pin cylinder defines a longer sliding pin cylinder section and a shorter sliding pin cylinder section extending from opposite sides of said medial plate.

5. The device of claim 4, wherein each said sliding pin coupling assembly further comprises said sliding pin boss sub-assembly being selectively positionable adjacent to one of said interior sliding pin coupling plate and said exterior sliding pin coupling plate, wherein a distance said sliding pin cylinder extends between said mast plates is adjustable.

6. The device of claim 5, further comprising each said sliding pin boss sub-assembly being reversibly positionable relative to said associated one of said mast plates, wherein a distance said sliding pin cylinder of each said sliding pin coupling assembly extends between said mast plates is adjustable.

7. The device of claim 1, wherein each of said sliding pin coupling assemblies further comprises a sliding pin spacer being couplable between said sliding pin boss sub-assembly and said load plate, wherein a distance said sliding pin cylinder extends between said mast plates is adjustable.

8. The device of claim 1, further comprising a plurality of sliding pin position apertures extending through each of said interior sliding pin coupling plate, said exterior sliding pin coupling plate, and said associated one of said mast plates, at least one sliding pin position apertures of each of said interior sliding pin coupling plate, said exterior sliding pin coupling plate, and said associated mast plate being alignable, wherein insertion of a positioning fastener through said aligned sliding pin positioning apertures fixes a position of said boss plate relative to said associated one of said mast plates.

9. The device of claim 1, further comprising a pair of fixed pin coupling assemblies, each said fixed pin coupling assembly comprising an interior fixed pin coupling plate;

an exterior fixed pin coupling plate;

an upward extension of a respective one of said mast plates being positioned between said interior fixed pin coupling plate and said exterior fixed pin coupling plate; and a fixed pin boss sub-assembly, said fixed pin boss sub-assembly having a fixed pin cylinder extending perpendicularly through a middle plate, said fixed pin cylinder extending through each of said interior fixed pin coupling plate, said exterior fixed pin coupling plate, and said upward extension of said respective one of said mast plates.

10. The device of claim 9, wherein each of said fixed pin coupling assemblies further comprises a plurality of fixed pin assembly fasteners, each fixed pin assembly fastener extending through each of said interior fixed pin coupling plate, said upward extension of said respective one of said mast plates, said exterior fixed pin coupling plate, said fixed pin spacer, and said fixed pin boss sub-assembly, wherein said fixed pin fasteners couple said interior fixed pin coupling plate, said exterior fixed pin coupling plate, said fixed pin spacer, and said fixed pin boss sub-assembly in fixed positions relative to said respective one of said mast plates.

11. The device of claim 9, wherein each of said fixed pin cylinders is positioned in linear alignment across said base plate, each of said fixed pin cylinders having an interior diameter complementary to an outer diameter of said fixed pin, wherein said fixed pin is positionable within and extending between said fixed pin cylinders.

12. The device of claim 9, wherein each of said fixed pin boss sub-assemblies has said middle plate being offset from a middle of said fixed pin cylinder, wherein said fixed pin cylinder defines a longer fixed pin cylinder section and a shorter fixed pin cylinder section extending from opposite sides of said middle plate.

13. The device of claim 12, wherein each said fixed pin coupling assembly further comprises said fixed pin boss sub-assembly being selectively positionable adjacent to one of said interior fixed pin coupling plate and said exterior fixed pin coupling plate, wherein a distance said fixed pin cylinder extends between said mast plates is adjustable.

14. The device of claim 13, further comprising each said fixed pin boss sub-assembly being reversibly positionable relative to said upward extension of said respective one of said mast plates, wherein a distance said fixed pin cylinder of each said fixed pin coupling assembly extends between said mast plates is adjustable.

15. The device of claim 9, wherein each of said fixed pin coupling assemblies further comprises a fixed pin spacer being couplable between said fixed pin boss sub-assembly and said upward extension of said respective one of said mast plates, wherein a distance said fixed pin cylinder extends between said mast plates is adjustable.

16. A variable excavator mast coupling device comprising:

a base plate;

a pair of mast plates, said pair of mast plates being coupled to and extending upwardly from said base plate, said mast plates being perpendicular to said base plate and parallel to each other;

a fixed pin coupled to and extending between said mast plates;

a sliding pin adjustably coupled to and extending between said mast plates, said sliding pin being parallel to said fixed pin;

a pair of sliding pin coupling assemblies, each of said sliding pin coupling assemblies being couplable to a respective one of said mast plates at an adjustable position, wherein said sliding pin is positionable a desired distance from said fixed pin, each said sliding pin coupling assembly comprising an interior sliding pin coupling plate, an exterior sliding pin coupling plate, a load plate, said load plate being positioned between said interior sliding pin coupling plate and said exterior sliding pin coupling plate, said load plate having a bottom edge positionable to abut a top edge of an associated one of said mast plates, wherein said load plate is slidable along said top edge of said associated one of said mast plates, a sliding pin boss sub-assembly, said sliding pin boss sub-assembly having a sliding pin cylinder extending perpendicularly through a medial plate, said sliding pin cylinder extending through each of said interior sliding pin coupling plate, said exterior sliding pin coupling plate, and said load plate, each of said sliding pin boss sub-assemblies has said medial plate being offset from said middle of said sliding pin cylinder, wherein said sliding pin cylinder defines a longer sliding pin cylinder section and a shorter sliding pin cylinder section extending from opposite sides of said medial plate, said sliding pin boss sub-assembly being selectively positionable adjacent to one of said interior sliding pin coupling plate and said exterior sliding pin coupling plate, wherein a distance said sliding pin cylinder extends between said mast plates is adjustable, each said sliding pin boss sub-assembly being reversibly positionable relative to said associated one of said mast plates, wherein a distance said sliding pin cylinder of each said sliding pin coupling assembly extends between said mast plates is adjustable, a plurality of upper sliding pin fasteners, each of said upper sliding pin fasteners extending through and fastening together said interior sliding pin coupling plate, said load plate, said exterior sliding pin coupling plate, and said sliding pin boss sub-assembly, a plurality of lower sliding pin fasteners, each of said lower sliding pin fasteners extending through aligned holes in said interior sliding pin coupling plate, said exterior sliding pin coupling plate, and a slot through one of said mast plates, said lower sliding pin fasteners compressing said one of said mast plates between said interior sliding pin coupling plate and said exterior sliding pin coupling plate such that said boss plate is secured in a selectable fixed position a desired spacing from said fixed pin, said sliding pin cylinders being positionable in linear alignment across said base plate, wherein said sliding pin is insertable through and extending between said sliding pin cylinders, a sliding pin spacer being couplable between said sliding pin boss sub-assembly and said load plate, wherein a distance said sliding pin cylinder extends between said mast plates is adjustable;

a plurality of sliding pin position apertures extending through each of said interior sliding pin coupling plate, said exterior sliding pin coupling plate, and said associated one of said mast plates, at least one sliding pin position apertures of each of said interior sliding pin coupling plate, said exterior sliding pin coupling plate, and said associated mast plate being alignable, wherein insertion of a positioning fastener through said aligned sliding pin positioning apertures fixes a position of said boss plate relative to said associated one of said mast plates;

a pair of fixed pin coupling assemblies, each said fixed pin coupling assembly comprising an interior fixed pin coupling plate, an exterior fixed pin coupling plate, an upward extension of a respective one of said mast plates being positioned between said interior fixed pin coupling plate and said exterior fixed pin coupling plate, a fixed pin boss sub-assembly, said fixed pin boss sub-assembly having a fixed pin cylinder extending perpendicularly through a middle plate, said fixed pin cylinder extending through each of said interior fixed pin coupling plate, said exterior fixed pin coupling plate, and said upward extension of said respective one of said mast plates, each of said fixed pin cylinders being positioned in linear alignment across said base plate, each of said fixed pin cylinders having an interior diameter complementary to an outer diameter of said fixed pin, wherein said fixed pin is positionable within and extending between said fixed pin cylinders, each of said fixed pin boss sub-assemblies having said middle plate being offset from a middle of said fixed pin cylinder, wherein said fixed pin cylinder defines a longer fixed pin cylinder section and a shorter fixed pin cylinder section extending from opposite sides of said middle plate, comprises said fixed pin boss sub-assembly being selectively positionable adjacent to one of said interior fixed pin coupling plate and said exterior fixed pin coupling plate, wherein a distance said fixed pin cylinder extends between said mast plates is adjustable, each said fixed pin boss sub-assembly being reversibly positionable relative to said upward extension of said respective one of said mast plates, wherein a distance said fixed pin cylinder of each said fixed pin coupling assembly extends between said mast plates is adjustable, a plurality of fixed pin assembly fasteners, each fixed pin assembly fastener extending through each of said interior fixed pin coupling plate, said upward extension of said respective one of said mast plates, said exterior fixed pin coupling plate, said fixed pin spacer, and said fixed pin boss sub-assembly, wherein said fixed pin fasteners couple said interior fixed pin coupling plate, said exterior fixed pin coupling plate, said fixed pin spacer, and said fixed pin boss sub-assembly in fixed positions relative to said respective one of said mast plates, and a fixed pin spacer being couplable between said fixed pin boss sub-assembly and said upward extension of said respective one of said mast plates, wherein a distance said fixed pin cylinder extends between said mast plates is adjustable.

* * * * *